US005452559A

United States Patent [19]

Lipes

[11] Patent Number: 5,452,559

[45] Date of Patent: Sep. 26, 1995

[54] BAGGING MACHINE WITH SIDE BAG GRIPPING AND TRANSFER MECHANISM

[76] Inventor: Arnold Lipes, 384 Olivier Street, Montreal, Quebec, Canada, H3Z 2C9

[21] Appl. No.: 287,491

[22] Filed: Aug. 8, 1994

[51] Int. Cl.[6] ..... B65B 43/44; B65B 67/12; B65B 43/28

[52] U.S. Cl. ..... 53/67; 53/570; 53/572

[58] Field of Search ..... 53/469, 570, 571, 53/572, 573, 385.1, 386.1, 67

[56] References Cited

U.S. PATENT DOCUMENTS

| | | | |
|---|---|---|---|
| 3,381,446 | 5/1968 | Marchand | 53/385.1 X |
| 3,581,459 | 6/1971 | Elliott et al. | 53/572 X |
| 3,945,173 | 3/1976 | Buzzi | 53/386.1 X |
| 4,124,966 | 11/1978 | Wilson | 53/385.1 X |
| 4,177,621 | 12/1979 | Powell, Jr. | 53/572 X |
| 4,370,845 | 2/1983 | Perolls et al. | 53/572 |
| 5,174,094 | 12/1992 | Powell, Jr. | 53/572 X |
| 5,177,939 | 1/1993 | Lipes | 53/572 |

*Primary Examiner*—Horace M. Culver

*Attorney, Agent, or Firm*—Swabey Ogilvy Renault; Guy J. Houle

[57] ABSTRACT

A bagging machine comprising a product discharge device for discharging one or more products in an open bag held at a bag loading position. The open bag is a forwardmost one of a plurality of collapsed bags supported in juxtaposition adjacent the bag loading position. The bags have a flap, contiguous with a rear wall of the bag, which extends above a mouth opening of the bag. The flap is supported by one or more wicket pins. An air jet nozzle is disposed above the mouth opening to open the forwardmost bag by separating the front wall of the bag from the rear wall. A bag gripping device is disposed on opposed sides of the forwardmost bag and has clamps to clamp an upper edge portion of the bag on opposed sides thereof when the mouth opening is opened by the air jet. The bag gripping element is secured to a pivotal linkage to cause the engaged clamps to move toward one another, inwardly of the bag, and downward to detach the bag from the one or more wicket pins while retaining the bag with one or more products discharged therein. Means is provided to disengage the gripping elements to release the bag with the products therein.

9 Claims, 3 Drawing Sheets

28
24
21
21
24
19
19
24'
24'
26
27
25'
25'
25
14'
16
20
25

17
16
14'
24
24'
30
18
29
30

21
28
21
24'
25'
25
16
14'
12
20

BAGGING MACHINE WITH SIDE BAG GRIPPING AND TRANSFER MECHANISM

TECHNICAL FIELD

The present invention relates to a bagging machine wherein a bag is held open by clamping devices which engage opposed sides of the bag to receive one or more products therein and wherein the clamping devices are displaced toward one another and downward from bag supporting elements to rip the bag off the bag supporting elements with the products disposed in the bag and for releasing the filled bag on a conveying means.

BACKGROUND ART

It is known to open an outermost one of a plurality of juxtaposed bags disposed at a loading position and wherein the bag can be held open by clamps while a product is loaded in the bag. It is also known to use clamps to displace a bag with the products therein to a location away from the loading position and at the same time rip the flap of the bag off wicket pins. Such a bagging machine is, for example, described in my U.S. Pat. No. 5,177,939 wherein a bag is held by clamps, stretched, transferred to a sealing station, and released only after the bag has been sealed. This type of bagging machine requires a plurality of clamping means to open the bag, to hold the bag in an open position and to displace it. The flap of the bag is held clamped in juxtaposed position with other bags and the front wall of the bag is pulled out by a front clamp to open the bag. Side clamps are then inserted in the bag to also support the bag and to stretch it after being filled. The clamps displace the bag while stretched so that the upper part of the bag may be sealed. Such a machine requires many valves, clamps and pistons in order to perform the necessary loading operation.

SUMMARY OF INVENTION

It is a feature of the present invention to provide an improved bagging machine which requires very few clamps, valves and pistons to perform a bag loading, detachment and transfer operation.

Another feature of the present invention is to also provide a bagging machine which is simple in operation, is reliable, and capable of detecting the absence of a bag at the bag loading position in a relatively simple manner.

According to the above features, from a broad aspect, the present invention provides a bagging machine comprising a product discharge means for discharging one or more products in an open bag held at a bag loading position. The open bag is a forwardmost one of a plurality of bags supported in juxtaposition adjacent the bag loading position. The bags have a flap contiguous with the rear wall of the bag and extending above a mouth opening thereof. The flap is supported by support means. Air jet means is provided to open the mouth opening by separating a front wall of the bag from a rear wall thereof. Bag gripping means is disposed on opposed sides of the forwardmost bag and provided with clamping means to clamp an upper portion of the bag on opposed sides thereof immediately when the mouth opening is opened by the air jet means. The bag gripping means is secured to a linkage to cause the clamping means to move downwards to detach the bag from the support means while retaining the bag with one or more products discharged therein. Means is also provided to disengage the gripping means to release the bag with the products therein.

BRIEF DESCRIPTION OF DRAWINGS

The present invention will now be described with reference to the accompanying drawings in which.

DESCRIPTION OF PREFERRED EMBODIMENTS

Figure 2:
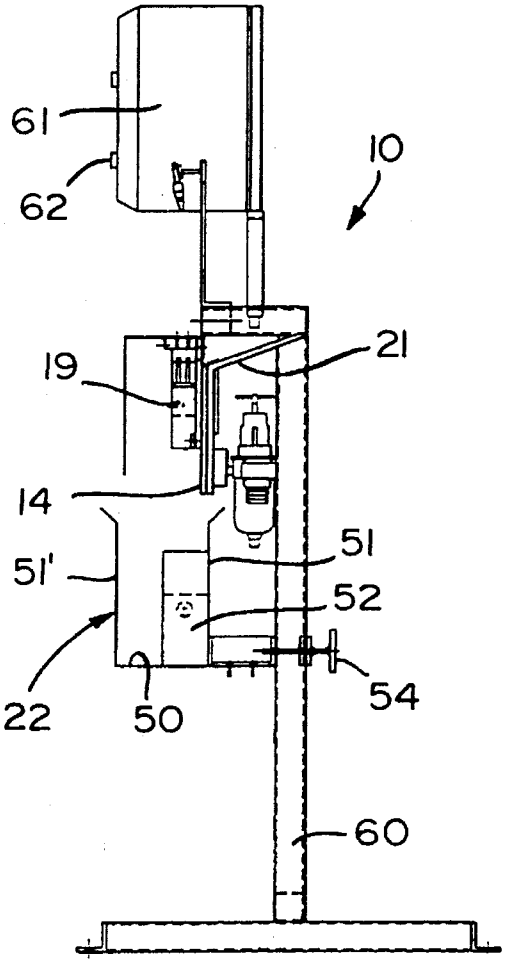
FIG. 2 is a side view of FIG. 1.
Figure 1:
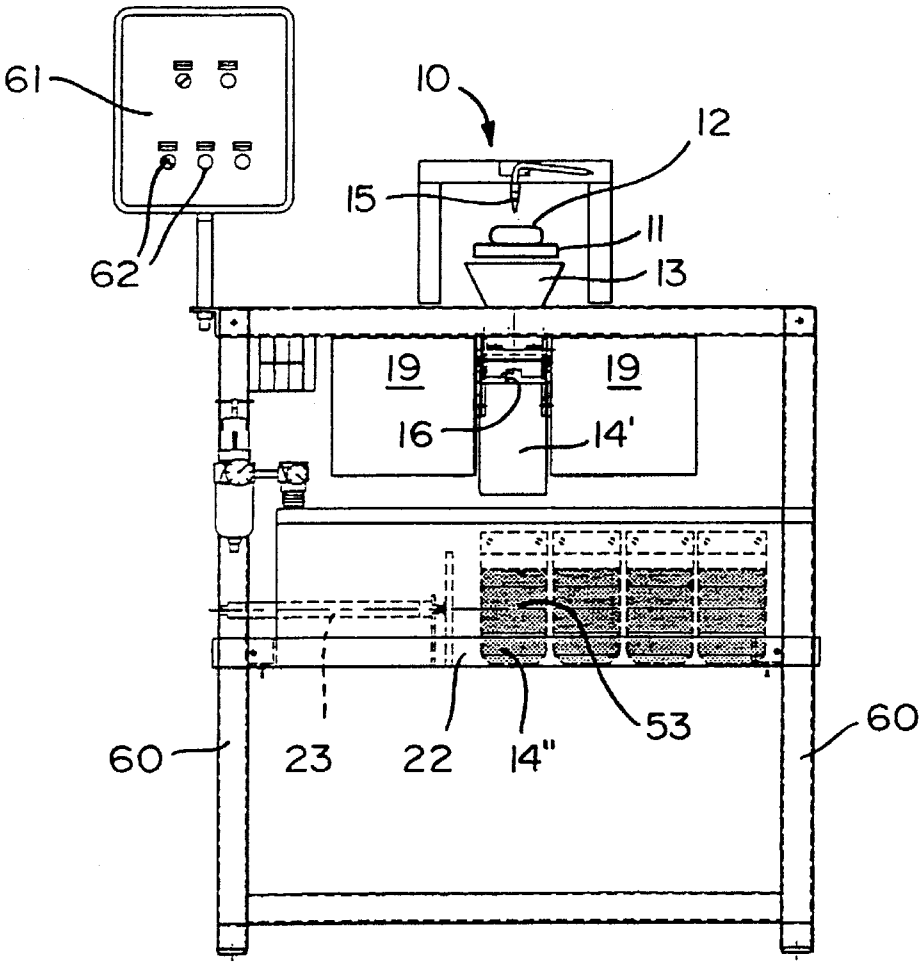
FIG. 1 is a front view of a bag loading machine constructed in accordance with the present invention.

Referring to the drawings, and more particularly to FIGS. 1 and 2, there is shown generally at 10 the bagging machine of the present invention. The machine comprises a product discharge conveyor 11 on which a product or a plurality of products 12, herein pouches, are conveyed to a discharge chute 13 conveniently position above a forwardmost one of the plurality of juxtaposed plastic bags 14, to discharge one or more of the products within the forwardmost bag 14' when held in an open position, as will be described later. An air jet 15 is disposed above the forwardmost bag 14' in alignment with a mouth opening 16 thereof to blow air at the mouth of the bag to open the bag by air pressure directed between a back wall 17 of the bag (see FIG. 4) and a front wall 18 thereof. A bag gripping and clamping mechanism 19 is disposed on opposed sides of the bag adjacent the mouth opening 16 and is actuable to clamp the upper side wall portions 20 of the forwardmost bag 14 to hold it in an open position while one or more of the products 12 is discharged within the bag.

The bag gripping and clamping mechanism 19 then displaces the bag downwardly to tear the flap 20 (see FIG. 3) of the bag off the wicket pins 21, and the bag is then discharged onto a discharge conveyor 22 where a pusher cylinder 23 and plate 52 are actuable to move the bags in side-by-side orientation. The pusher plate 52, when retracted makes clearance for the next bag to be discharged onto the conveyor 22. As shown in FIG. 2, the conveyor 22 is a trough conveyor and its construction will be described later.

Figure 3:
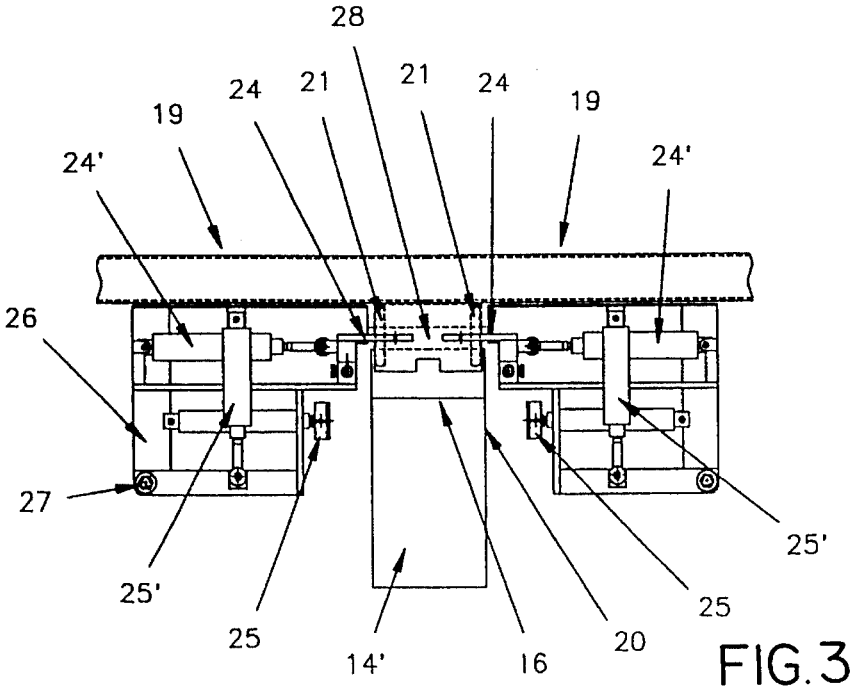
FIG. 3 is a simplified front view showing the position of the bag gripping and clamping mechanism disposed on opposed sides of a forwardmost one of a plurality of juxtaposed bags.
Figure 4:
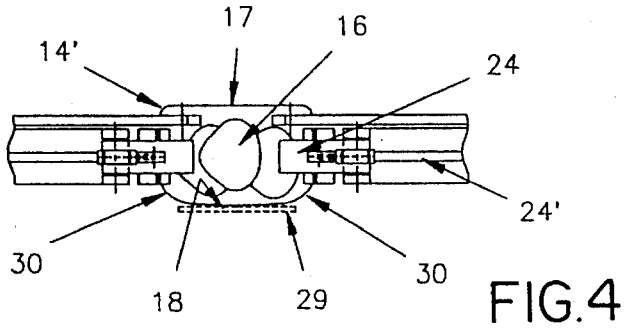
FIG. 4 is a top view of FIG. 1 showing the outermost ones of the bags in an open position.
Figure 5:
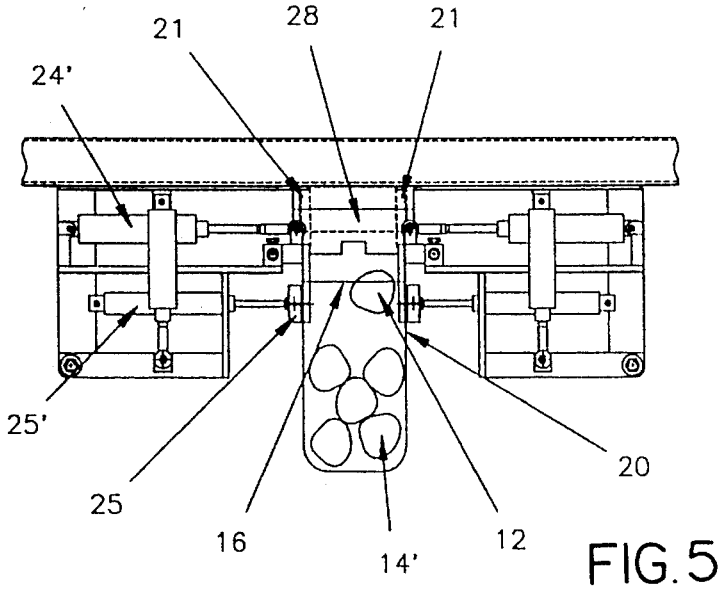
FIG. 5 is a further front view showing the bag ripping and clamping mechanism engaged with the uppermost side portions of the forwardmost one of the bags.

Referring now additionally to FIGS. 3 to 6 there will be described the construction and operation of the bagging machine, particularly the bag gripping and clamping mechanism 19. As shown more clearly in FIG. 3, the bag gripping and clamping mechanism 19 comprises an inner piston-operated clamp plate 24 and an outer piston-operated clamp head 25 movable against the clamp plate when the clamp plate 24 is disposed in a clamping position inside the open bag, as shown in FIG. 5 and lies substantially vertically within the outermost bag 14' with the upper edge portion 20 of the bag 14' extending between the clamp plate 24 and head 25. Both the clamp plate 24 and the clamp head 25 are operated by respective cylinders 24' and 25'. These cylinders are mounted on a support frame 26 which is pivotally secured to a pivot connection 27.

As shown in FIG. 3, the outermost one 14 of the plastic bags is held in juxtaposition by an arresting plate 28 disposed on or across the flap 20 with the wicket pins 21 extending through holes provided in the flap. The air jet 15 is actuated to direct an air jet stream to the mouth opening 16. This separates the back wall 17 from the front wall 18, as shown in FIG. 4. If the bag is fairly large, it is desirable to secure a stationary arresting plate 29 at a 10 predetermined distance in front of the arresting plate 28 so that when the bag 14' is opened it will assume a generally rectangular configuration, substantially as shown in FIG. 4 with the side walls 30 thereof extending across the clamp plate 24.

The piston 24' is then operated whereby the clamp plate 24 is tilted downwardly into the bag on its articulation 31 to assume its clamping position, as shown in FIG. 5. As soon as the clamp plate 24 is disposed vertically within the bag, the clamp head piston 25' is then actuated to move the clamp head 25 against the upper side wall portion 20 of the bag and against the clamp plate 24 to clamp the bag in an open position. Accordingly, the bag is clamped from both sides in an open position and the articles 12 can then be discharged into the mouth opening 16, as shown in FIG. 5.

Figure 6:
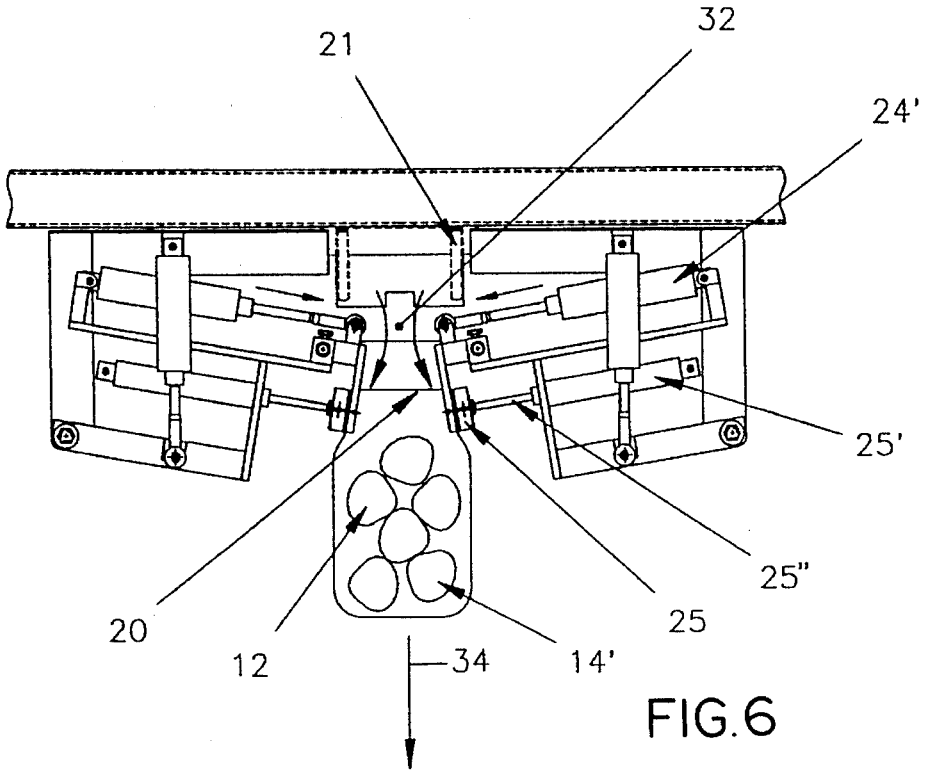
FIG. 6 is a further front view showing the bag ripped off the wicket pins by the bag gripping and clamping mechanism, as well as illustrating the action of the bag ripping and clamping mechanism.

After the article(s) 12 are discharged within the bag 14' the support frame 26 of the bag gripping and clamping mechanism 19 is tilted downwardly in the direction of arrows 32 while simultaneously the pistons 24' and 25' are actuated to move the clamp plate and clamp head inwardly towards one another. This causes the bag to rip off the wicket pin 21, as shown in FIG. 6, and the bag is then released onto the discharge conveyor trough 22 by retracting the piston rod 25" of the piston 25' causing the piston head 25 to release the clamping action, and the bag to fall in the direction of arrow 34 by gravity.

Figure 7:
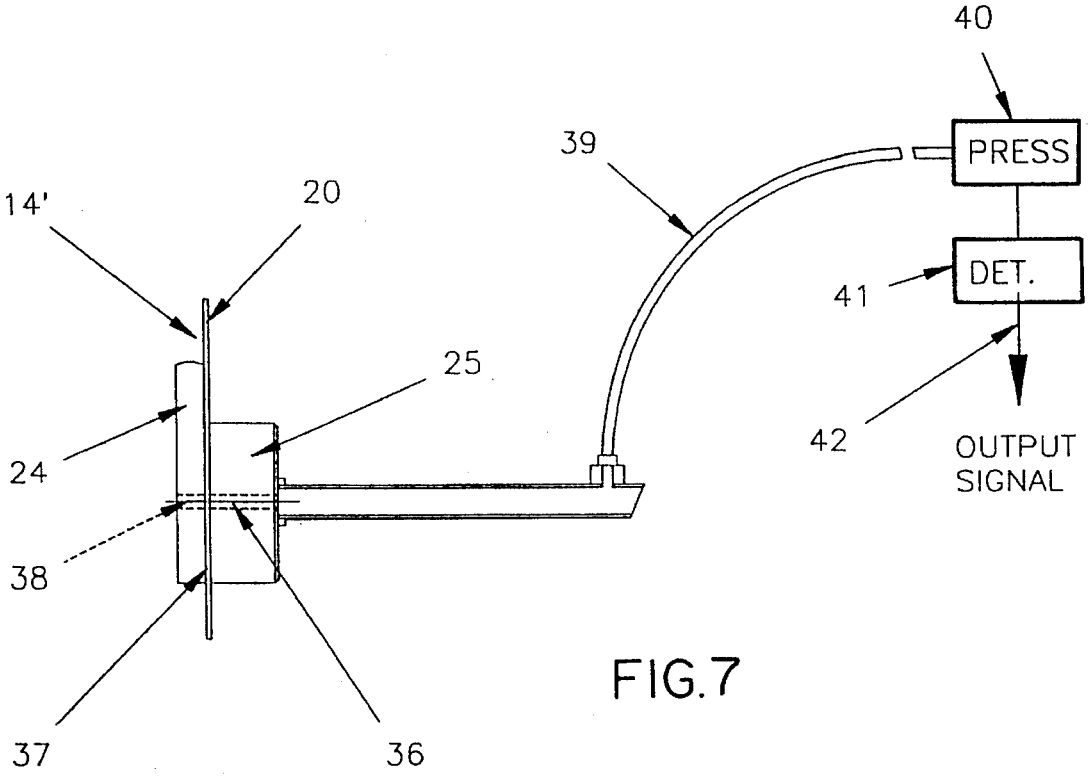
FIG. 7 is a simplified schematic view illustrating the bag detection circuit.

Referring now to FIG. 7, there is shown a simple bag detection means which is associated with the clamp plate 24 and the clamp head 25. The detection is provided by an air pressure passage 36 formed at the center of the clamping head 25 and extending to its clamping face 37. This air pressure passage 36 is aligned with an orifice 38 which is provided in the clamp plate 24. When the upper edge portion 20 of the bag 14' is disposed in clamping engagement between the clamp head 28 and clamp head 24 the air pressure passage 36 is sealed. As shown in FIG. 7, a pressure conduit 39 connects a pressure source 40 to the passage 36. A detector 41 detects the pressure within the conduit 39. If the upper side wall portion 20 of the bag 14 is clamped, then the monitored pressure is normal and the discharge cycle for the articles to be positioned in the bag will take place. In the absence of a bag between the clamping plate 24 and the clamping head 25, the pressure in the passage 36 will be evacuated through the orifice 38, as there is no obstruction of the passage 36. This will cause a pressure drop which will be detected by the detector 41 which will then transmit an output signal at its output 42 to cause the bag opening cycle to repeat causing the air jet 15 to again operate. Prior to the operation of the bag opening cycle the clamp plates and clamp head are withdrawn to their initial position as shown in FIG. 3. It is pointed out that if after a predetermined number of cycles a bag is not detected between the clamp plate and the clamp head, then an alarm, either visual and/or audible, can be triggered by the detector whereby an operator can inspect the machine to see if the forwardmost bag is defective or if there is another machine malfunction.

Referring now again to FIGS. 1 and 2, there will be briefly described the construction of the discharge conveyor trough 22. As herein shown, the conveyor 22 is comprised of an elongated bottom wall 50 having opposed side walls or guide walls 51, with one of the guide walls, herein guide wall 51', being adjustable to vary the width of the discharge conveyor trough to accommodate bags of different sizes. The push-off cylinder is connected to the pusher plate 52 which is positioned in the trough as shown in FIG. 2. This pusher plate is disposed adjacent the bag receiving location 53 to push a bag 14", as shown in FIG. 1, as soon as it is released in the trough so that the bag is pushed against adjacent bags wherein the bags are conveyed and may be ejected onto another discharge conveyor at a discharge end, not shown herein but obvious to a person skilled in the art.

The advantage of the bagging machine of the present invention is its simplicity of construction utilizing only a few solenoid valves and two side gripping mechanisms. The machine is conveniently mounted on a frame 60, shown in FIGS. 1 and 2, which could be supported on locking casters, not shown. A swivel control panel 61 is made accessible to an operator and is provided with controls 62 to adjust the speed of operation and to control the various cycles of operation of the gripping mechanism. The adjustment knob 54 is utilized to adjust the width of the trough discharge conveyor 22.

It is within the ambit of the present invention to cover any other obvious modifications of the preferred embodiment described herein, provided such modifications fall within the scope of the appended claims.

I claim:

1. A bagging machine comprising a product discharge means for discharging one ore more products in an open bag held at a bag loading position, said open bag being a forwardmost one of a plurality of bags supported in juxtaposition adjacent said bag loading position, said bags having a flap contiguous with a rear wall of said bag and extending above a mouth opening of said bag, said flap being supported by support means, air jet means to open said mouth opening by separating a front wall of said bag from said rear wall, bag gripping means disposed on opposed sides of said forwardmost bag and having clamping meaning to clamp an upper edge portion of said bag on opposed sides thereof when said mouth opening is opened by said air jet means, said bag gripping means being secured to a pivotal linkage to cause said clamping means to move toward one another inwardly of said bag and downwards to detach said bag from said support means while retaining said bag with said one or more products discharged therein, and means to disengage said gripping means to release said bag with said products therein said clamping means having an inner piston-operated clamp plate and an outer piston-operated clamp head movable against said clamp plate when in clamping position within said bag with said upper edge portion of one of said opposed sides of said bag therebetween.

2. A bagging machine as claimed in claim 1 wherein there is further provided bag detection means associated with said clamping means.

3. A bagging machine as claimed in claim 2 wherein said bag detection means is comprised by an air pressure passage located in a clamping face of said clamp head and aligned with an orifice in said clamp plate, said upper edge portion of said bag when disposed in clamping engagement between said clamp head and said clamp plate preventing the flow of pressurized air between said passage and said orifice to signify the presence of a bag being gripped by said gripping means.

4. A bagging machine as claimed in claim 1 wherein there is further provided a discharge conveyor disposed spaced below said bag loading position, said bag being released on said discharge conveyor by said gripping means.

5. A bagging machine as claimed in claim 4 wherein said discharge conveyor is a conveyor trough comprised of an elongated bottom wall, opposed guide walls and an open discharge end, a pusher element adjacent a bag receiving location where said bag is discharged by said gripping means, said discharged bag being pushed toward said open discharge end a distance sufficient to permit another bag to be discharged on said conveyor; said another bag, after being discharged, being pushed against said previously discharged bag so that a plurality of said discharged bags are conveyed on said bottom wall between said guide walls towards said open discharge end by said pusher element.

6. A bagging machine as claimed in claim 5 wherein one of said guide walls is adjustable to modify the width of said conveyor trough.

7. A bagging machine as claimed in claim 1 wherein there is further provided a stationary arresting means disposed in spaced forward alignment in front of said outermost one of said bags and aligned below said mouth opening of said bag to form an abutment for said bag front wall when blown open by said air jet means to configure the opening of said mouth opening to permit entry of said clamp plates within said open bag from opposed sides thereof.

8. A bagging machine as claimed in claim 1 wherein said means to disengage said gripping means is a piston cylinder which operates said clamping means.

9. A bagging machine as claimed in claim 1 wherein said support means is a pair of wicket pins.

* * * * *